US011872615B2

(12) United States Patent
Große Lordemann

(10) Patent No.: US 11,872,615 B2
(45) Date of Patent: Jan. 16, 2024

(54) COOLING DEVICE FOR COOLING A MATERIAL TO BE COOLED

(71) Applicant: SMS GROUP GMBH, Düsseldorf (DE)

(72) Inventor: Frederik Große Lordemann, Heiligenhaus (DE)

(73) Assignee: SMS GROUP GMBH, Dusseldorf (DE)

( * ) Notice: Subject to any disclaimer, the term of this patent is extended or adjusted under 35 U.S.C. 154(b) by 772 days.

(21) Appl. No.: 16/971,387

(22) PCT Filed: Feb. 26, 2019

(86) PCT No.: PCT/EP2019/054705
§ 371 (c)(1),
(2) Date: Aug. 20, 2020

(87) PCT Pub. No.: WO2019/162522
PCT Pub. Date: Aug. 29, 2019

(65) Prior Publication Data

US 2020/0384516 A1 Dec. 10, 2020

(30) Foreign Application Priority Data

Feb. 26, 2018 (DE) ..... 10 2018 202 843.5

(51) Int. Cl.
*B21B 45/02* (2006.01)

(52) U.S. Cl.
CPC ..... *B21B 45/0218* (2013.01)

(58) Field of Classification Search
CPC ... B21B 45/0218; B21B 45/0233; B05B 3/00; B05B 3/001; B05B 7/16; B05B 7/1606; B05B 7/168; B05B 7/1686
See application file for complete search history.

(56) References Cited

U.S. PATENT DOCUMENTS 4,744,226 A * 5/1988 Noville ..... C21D 1/667 62/374

FOREIGN PATENT DOCUMENTS

| | | |
|---|---|---|
| CN | 200 954 521 Y | 10/2007 |
| CN | 101838724 A | 9/2010 |
| CN | 103316934 A | 9/2013 |
| CN | 104 174 670 A | 12/2014 |

(Continued)

OTHER PUBLICATIONS

Chinese Office Action dated Sep. 16, 2021, in connection with corresponding CN application No. 201980015310.1 (15 pp., including machine-generated English translation).

(Continued)

*Primary Examiner* — Kun Kai Ma
(74) *Attorney, Agent, or Firm* — Maier & Maier, PLLC

(57) ABSTRACT

A cooling device for cooling a material to be cooled, comprising an inlet for a cooling medium conducted into a first, upper chamber of the cooling device. First conduits are provided which conduct the cooling medium from the upper chamber into a second, lower chamber of the cooling device. The upper chamber is separated from the lower chamber by a wall. Second conduits are provided which conduct the cooling medium from the lower chamber to at least one outlet opening for cooling medium, via which the cooling medium is discharged onto the material to be cooled.

20 Claims, 1 Drawing Sheet

(56) References Cited

FOREIGN PATENT DOCUMENTS

| | | | | | |
|---|---|---|---|---|---|
| DE | 10 2004 015 741 | A1 | | 10/2005 | |
| EP | 1157755 | A2 | | 11/2001 | |
| GB | 2 529 072 | A | | 2/2016 | |
| JP | H01178309 | A | | 7/1989 | |
| JP | 2006219732 | A | | 8/2006 | |
| KR | 20090056190 | A | * | 6/2009 | |
| KR | 20120071711 | A | * | 7/2012 | |
| WO | WO-2012011578 | A1 | * | 1/2012 | ..... B21B 45/0233 |

OTHER PUBLICATIONS

Examination Report dated Feb. 21, 2019 of corresponding German application No. 10 2018 202 843.5; 12 pgs.
International Search Report dated Jun. 4, 2019 in corresponding International application No. PCT/EP2019/054705; 14 pgs.
Japanese Office Action dated Sep. 7, 2021, in connection with corresponding JP Application No. 2020-544640 (8 pp., including machine-generated English translation).

* cited by examiner

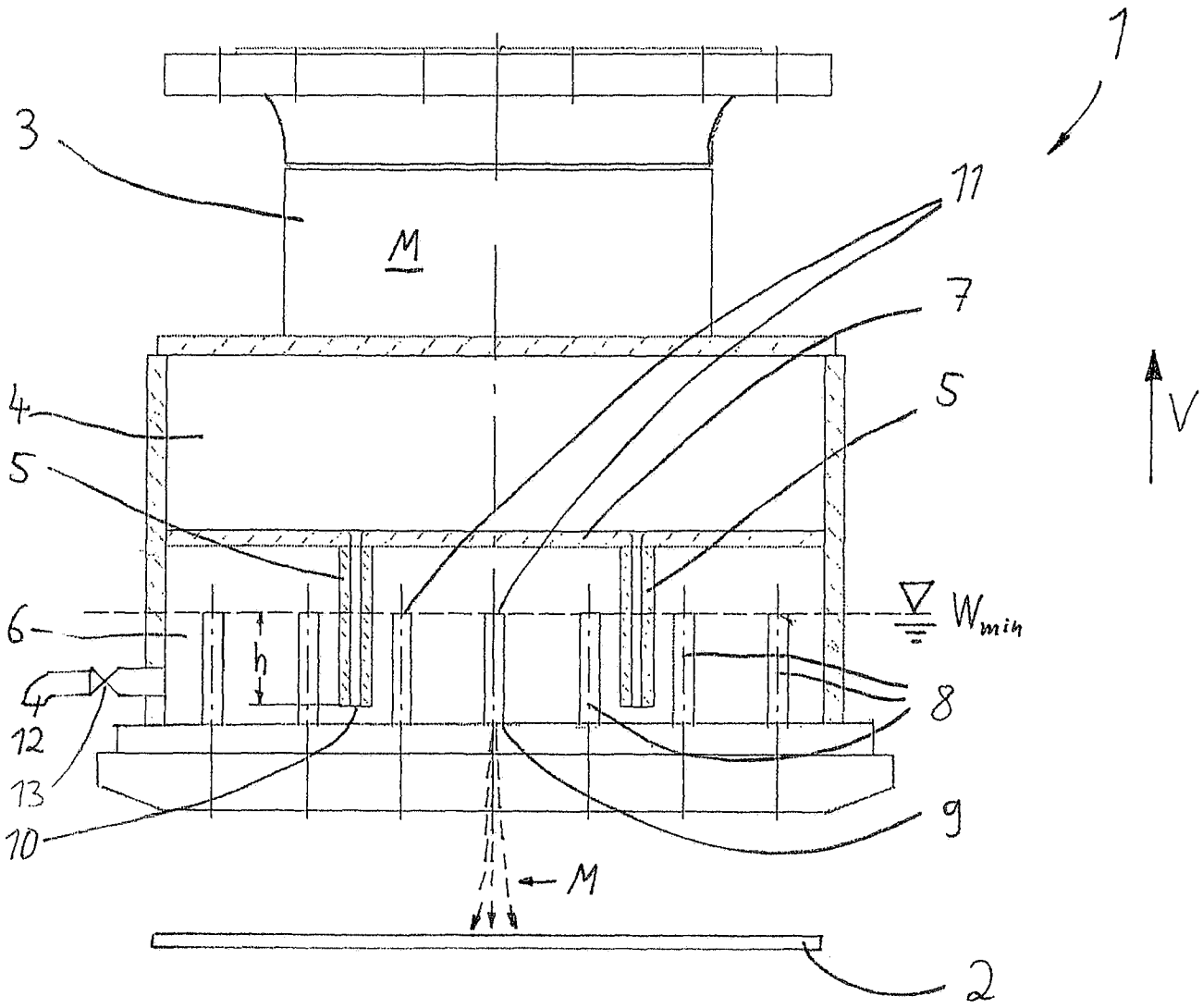
1
V
11
7
5
$W_{min}$
8
9
2
M
M
3
4
5
6
4
12
13
10
h

COOLING DEVICE FOR COOLING A MATERIAL TO BE COOLED

FIELD

The invention relates to a cooling device for cooling a material to be cooled, comprising an inlet for a cooling medium which conducts it into a first, upper chamber of the cooling device, wherein first conduit means are provided which conduct the cooling medium from the upper chamber into a second, lower chamber of the cooling device, wherein the upper chamber is separated from the lower chamber by a wall, wherein second conduit means are provided which conduct the cooling medium from the lower chamber to at least one outlet opening for the cooling medium, via which the cooling medium is discharged onto the material to be cooled.

BACKGROUND

Such a cooling device is described in CN 103316934 A. The cooling water is conducted here from an upper chamber via pipes into the lower chamber, which pipes are attached to the wall mentioned and extend upward from this over a certain height into the upper chamber. From a certain level in the upper chamber, cooling water then runs into the lower chamber, on the bottom of which outlet pipes for the cooling water are attached, via which the cooling water runs out as soon as a corresponding level is reached in the lower chamber. Another similar solution is disclosed in CN 101838724 A.

Another solution is disclosed in GB 2 529 072 B. Here, too, the cooling chamber is divided into two parts. The wall (partition plate) between the two subchambers has holes through which the cooling water flows. When the cooling bar is switched off, the entire volume has to be emptied from the cooling bar and partially from the pipelines. This takes a long time. To speed up the emptying, emptying valves have to be used here. However, they have to be controlled by the automation, which is prone to faults and is complex. If one takes into consideration the possible installation space for emptying fittings in such solutions, arbitrarily large valves cannot be used. It has been shown that the emptying times in the case of such solutions are sometimes significantly longer than 1 minute. If the cooling bar is to be self-cooled, this has to be carried out via separate piping. Otherwise, it cannot be ensured that cooling water does not drip from the nozzles onto the rolled material.

The previously known solutions are cooling devices for rolled material which are used above and below the rolled material in order to apply the cooling medium to it and thus cool it down. Water is usually used as the cooling medium for this purpose.

In this case, for example, the rolled material is cooled in one pass in a cooling device for heavy plate, wherein the rolled material is transported by means of rollers through the cooling. When the end of the rolled material (plate) has left the cooling, the cooling bars are switched off. After the water supply to the cooling bar is ended, in particular in the upper cooling bar equipped with nozzles, relatively long after-running or dripping of the cooling bars occurs.

If sheets are to be produced in rapid succession, wherein not every sheet is to be cooled, the time for emptying the cooling bars plays a decisive role. The next sheet which is not to be cooled can only pass the cooling device when water no longer drips from the upper cooling bar. Therefore, rapid emptying of the upper cooling bars is necessary. In the previously known embodiments of the cooling bars, the emptying can take between 1 and 3 minutes. This is because all of the water above the nozzle opening has to drain out of the cooling bar.

In the previously known solutions, the cooling medium thus flows via the fitting into an internal distributor pipe in the interior of the cooling bar. The outlet openings of the distributor are always below the minimum cooling medium level in this case. When the cooling bar is switched off, the water level first has to sink to the minimum level. It is sometimes difficult in such systems to arrange the individual cooling nozzles uniformly over the cooling bar, which disadvantageously results in uneven cooling.

The self-cooling of the cooling device, which is required in the case that the cooling device is not used but hot material passes below it, has not been satisfactorily achieved in the previously known solutions.

SUMMARY

The invention is based on the object of refining a cooling device of the type mentioned at the outset in such a way that long dripping after ending the cooling process can be avoided. Rapid stopping of the drainage of the cooling medium is thus to be effectuated, i.e., cooling bars are to be provided which enable rapid running empty. It is furthermore to be ensured that the most uniform possible cooling takes place and locally concentrated application of water can be avoided. However, complex or fragile elements (valves, etc.) are to be able to be avoided for this purpose. A further important aspects is that it is to be possible in an effective manner to self-cool the cooling device during cooling breaks.

The achievement of this object by the invention is characterized in that the first conduit means adjoins the wall at its upper end or penetrates the wall upwards and protrude into the lower chamber and open therein with an open end, in that the second conduit means protrude upward from a bottom region of the lower chamber into the lower chamber and open therein with an open end, wherein the lower end of the first conduit means are located below the upper end of the second conduit means.

The second conduit means preferably penetrate the bottom region of the lower chamber to discharge the cooling medium onto the material to be cooled.

The vertical extension from the lower end of the first conduit means up to the upper end of the second conduit means is preferably between 0.01 m to 1.00 m in this case, particularly preferably between 0.1 m and 0.5 m.

The first conduit means are preferably formed by at least one pipe which is fastened on or in the wall, preferably on the lower side of the wall, and is fluidically connected to the upper chamber.

The second conduit means are preferably formed by at least one pipe, in particular having any arbitrary cross section, which is fastened on the bottom region of the lower chamber. In this case, it is preferably provided that the second conduit means is formed by a plurality of pipes, wherein spray nozzles for the cooling medium are arranged at the end of the pipes. The spray nozzles for the cooling medium are preferably arranged uniformly distributed on the lower side of the lower chamber or on a component connected thereto.

A drain for the cooling medium is preferably arranged in the lower chamber, wherein controllable shut-off elements (in particular valve means) are preferably arranged in the drain. The drain is preferably arranged at a height position of the lower chamber which is below the upper end of the second conduit means.

At least one emptying element (in particular an emptying valve) can be arranged on the lower chamber to be able to drain the cooling medium from the chamber.

At least one venting element (in particular a venting valve) can be arranged on the inlet and/or on the upper chamber and/or on the lower chamber.

The proposed solution advantageously results in the cooling medium emerging very quickly from the cooling device and thus being able to effectively avoid long dripping after ending the cooling process.

It is also very advantageous that effective self-cooling of the cooling device can still be maintained during the cooling breaks.

Finally, it is possible in a simple manner to ensure very uniform and homogeneous water distribution in the width direction (i.e., transverse to the conveying direction of the material to be cooled).

The proposed cooling device is suitable for heavy plate rolling mills, for hot strip trains, and for heat treatment lines, in particular for steel materials. Similarly, however, an application for nonferrous metals is also possible.

A cooling model computer can be provided, which enables intelligent regulation of the cooling device. The cooling model computer is to switch off the cooling device depending on the actual running empty time. The computer is to determine the required target times either independently on the basis of the existing process data or is to adopt specifications from other process model computers.

In order to further shorten the emptying time, emptying elements are advantageously provided. In order that the cooling bar can be better vented during the starting process, venting elements can be provided on the chambers and/or pipelines. These venting elements can also improve the emptying behavior if they are opened when the main supply is closed. Air can thus flow rapidly into the cooling bar.

The proposed concept thus allows the cooling device to be emptied rapidly after the cooling process. The running empty behavior is improved by measures that are easy to implement. The number of moving parts (which are prone to faults like valves etc.) can be reduced. Uniform and homogeneous water distribution is ensured in the direction transverse to the conveying direction of the material to be cooled.

Homogeneous and large-area application of the cooling medium to the rolled material is possible. The space requirement is minimized for the cooling device described. Effective self-cooling to protect the cooling bars is also possible.

An exemplary embodiment of the invention is illustrated in the drawings. The single FIGURE shows the side view of a cooling device, using which a material to be cooled is cooled.

BRIEF DESCRIPTION OF THE DRAWINGS

In the FIGURE, a cooling device 1 can be seen, by means of which a material 2 to be cooled, for example a strip, is cooled by means of a cooling medium M (water). The cooling medium M passes via an inlet 3 into an upper first chamber 4 in the vertical direction V. A lower second chamber 6 is arranged below the upper chamber 4, wherein the two chambers 4, 6 are separated from one another by a wall 7.

DETAILED DESCRIPTION

On the lower side of the wall 7, multiple (in the exemplary embodiment two) straight pipes having any arbitrary cross section (first conduit means) 5 are arranged, wherein they are mechanically fastened on or in the wall 7, but are fluidically connected to the upper chamber 4. Accordingly, water can flow via these pipes 5 from the upper chamber 4 into the lower chamber 6.

To discharge the water from the lower chamber 6 onto the material 2, a number of straight pipes having any arbitrary cross section (second conduit means) 8 are provided, which extend upward from the bottom region of the lower chamber 6; at their lower end, an outlet opening 9 is located, which functions as a nozzle, using which the water is discharged onto the material 2. It is indicated by dashed lines in the FIGURE for the middle nozzle or outlet opening 9 how the water M reaches the material 2 to be cooled.

The first conduit means 5 have an open end 10, while the second conduit means 8 have an open end 11. It is essential that the lower end 10 of the first conduit means 5 lies below the upper end 11 of the second conduit means 8. The resulting vertical extension is marked by h.

A value thus results for the minimum water level $W_{min}$ in the lower chamber 6, which is defined by the upper end 11 of the second conduit means 8. As long as this level is exceeded, water emerges from the outlet openings 9; if the level reaches or falls below this level, water no longer emerges from the outlet openings 9.

A drain 12 is arranged in the lower chamber 8 below said level $W_{min}$ and can be opened and closed, for example, using controllable shut-off elements 13.

On the basis of the proposed design of the cooling device 1, the present concept therefore focuses on an upper and a lower chamber, which are connected to one another by internal pipes having any arbitrary cross section (first conduit means 5). The outflow opening of these pipes (first conduit means) is always below the minimum level $W_{min}$ (water level) of the lower chamber 6. This prevents the upper chamber 4 and the connected piping (inlet) from running empty. The number and the cross section of the first conduit means 5 are arbitrary.

If the cooling is stopped and thus the water supply via the inlet 3 to the cooling device 1 is closed, only the volume from the wall 7 of the lower chamber 6 to the open end 11 of the second conduit means 8 has to run empty.

It has been shown that the time to run empty can be reduced to well below 1 minute by these measures. It is nonetheless possible to distribute the outlet nozzles for the cooling medium homogeneously and uniformly over the available cooling surface of the cooling device.

The above-mentioned construction of the cooling device 1 makes it possible to supply the cooling bar with a small quantity of cooling medium via the inlet 3 after the running empty and opening of the shut-off element 13. This quantity then ensures that the cooling device is cooled from the inside when material (sheets) have to pass the cooling device 1 without being cooled by it. The cooling medium for self-cooling can run off via the drain 12 in the cooling device without flowing out of the nozzles onto the material and cooling it. For this purpose, the drain 12 is arranged below the upper end 11 of the second conduit means.

The invention claimed is:

1. A cooling device for cooling a material to be cooled, comprising:

an inlet for a cooling medium which it is conducted into a first, upper chamber of the cooling device, wherein first conduits are provided which conduct the cooling medium from the first, upper chamber into a second, lower chamber of the cooling device, wherein the first, upper chamber is separated from the second, lower chamber by a wall, wherein second conduits are provided which conduct the cooling medium from the second, lower chamber to at least one outlet opening for the cooling medium, via which the cooling medium is discharged onto the material to be cooled, wherein the first conduits adjoin the wall with their upper end or penetrate them upwards and protrude into the lower chamber and open into an open lower end, wherein the second conduits protrude upward from a bottom region of the lower chamber into the lower chamber and open into an open upper end, wherein the open lower end of the first conduits lies below the open upper end of the second conduits.

2. The cooling device as claimed in claim 1, wherein the vertical extension from the open lower end of the first conduits to the open upper end of the second conduits is between 0.01 m to 1.00 m.

3. The cooling device as claimed in claim 1, wherein the first conduits are formed by at least one pipe which is fastened on or in the wall and is fluidically connected to the upper chamber.

4. The cooling device as claimed in claim 1, wherein the second conduits are formed by at least one pipe which is fastened on the bottom region of the lower chamber.

5. The cooling device as claimed in claim 4, wherein the second conduits are formed by a plurality of pipes, wherein spray nozzles for the cooling medium are arranged at the end of the plurality of pipes.

6. The cooling device as claimed in claim 5, wherein the spray nozzles for the cooling medium are one of: uniformly distributed on the lower side of the lower chamber, or uniformly distributed on an intervening component which is connected to the lower side of the lower chamber.

7. The cooling device as claimed in claim 1, wherein a drain for the cooling medium is arranged in the lower chamber, wherein controllable shut-off elements are arranged in the drain.

8. The cooling device as claimed in claim 7, wherein the drain is arranged at a height position of the lower chamber which is below the open upper end of the second conduits.

9. The cooling device as claimed in claim 1, wherein at least one emptying element is arranged on the lower chamber in order to be able to drain the cooling medium from the chamber.

10. The cooling device as claimed in claim 1, wherein at least one venting element is arranged on the inlet and/or on the upper chamber and/or on the lower chamber.

11. The cooling device as claimed in claim 2, wherein the first conduits are formed by at least one pipe which is fastened on or in the wall and is fluidically connected to the upper chamber.

12. The cooling device as claimed in claim 2, wherein the second conduits are formed by at least one pipe which is fastened on the bottom region of the lower chamber.

13. The cooling device as claimed in claim 3, wherein the second conduits are formed by at least one pipe which is fastened on the bottom region of the lower chamber.

14. The cooling device as claimed in claim 2, wherein a drain for the cooling medium is arranged in the lower chamber, wherein controllable shut-off elements are arranged in the drain.

15. The cooling device as claimed in claim 3, wherein a drain for the cooling medium is arranged in the lower chamber, wherein controllable shut-off elements are arranged in the drain.

16. The cooling device as claimed in claim 4, wherein a drain for the cooling medium is arranged in the lower chamber, wherein controllable shut-off elements are arranged in the drain.

17. The cooling device as claimed in claim 5, wherein a drain for the cooling medium is arranged in the lower chamber, wherein controllable shut-off elements are arranged in the drain.

18. The cooling device as claimed in claim 6, wherein a drain for the cooling medium is arranged in the lower chamber, wherein controllable shut-off elements are arranged in the drain.

19. The cooling device as claimed in claim 2, wherein at least one emptying element is arranged on the lower chamber in order to be able to drain the cooling medium from the chamber.

20. The cooling device as claimed in claim 3, wherein at least one emptying element is arranged on the lower chamber in order to be able to drain the cooling medium from the chamber.

* * * * *